US009883287B2

(12) United States Patent
Liu

(10) Patent No.: US 9,883,287 B2
(45) Date of Patent: Jan. 30, 2018

(54) 3D FIVE-CHANNEL STEREO EARPHONE

(71) Applicants: Dan Yuan, HuiZhou, Guangdong (CN); Lian Qun Li, HuiZhou, Guangdong (CN)

(72) Inventor: Guo Qing Liu, HuiZhou (CN)

(73) Assignee: Dongguan Mocrox Electronic Technology Co., Ltd., Dongguan (CN)

( * ) Notice: Subject to any disclaimer, the term of this patent is extended or adjusted under 35 U.S.C. 154(b) by 0 days.

(21) Appl. No.: 15/359,619

(22) Filed: Nov. 23, 2016

(65) Prior Publication Data

US 2017/0325027 A1 Nov. 9, 2017

(30) Foreign Application Priority Data

May 6, 2016 (CN) ..... 2016 1 0298893

(51) Int. Cl.
*H04R 5/02* (2006.01)
*H04R 5/033* (2006.01)
*H04R 5/04* (2006.01)

(52) U.S. Cl.
CPC ..... *H04R 5/033* (2013.01); *H04R 5/04* (2013.01)

(58) Field of Classification Search
CPC ..... H04R 1/01; H04R 1/1008; H04R 1/1016; H04R 1/1058; H04R 1/1066; H04R 1/1075; H04R 5/033; H04R 2201/10; H04R 2201/105; H04R 2205/022
USPC ..... 381/370, 371, 309, 380
See application file for complete search history.

(56) References Cited

U.S. PATENT DOCUMENTS

2004/0218775 A1* 11/2004 Huang ..... H04R 1/1075 381/371

* cited by examiner

*Primary Examiner* — Katherine Faley

(57) ABSTRACT

A 3D five-channel stereo earphone, comprising: a rear housing, a frame installed on the rear housing, a loudspeaker mounted at a bottom of the frame, a front housing installed on the rear housing; the frame and loudspeaker being sealed and installed in a cavity between the rear housing and the front housing; the front housing having an output; the frame including several mutually isolated output channels connected to the output; the output channels having input holes disposed at the bottom of the frames and on the same horizontal plane; the output channels having output holes disposed on an upper surface of the frame, and the vertical distances between the output holes and the output are different; the headphone enables the optimum sound effects, acoustic quality, stimulated 3D sound effects and the 5.1-channel stereo sound, without adding any electronic circuits or applications.

6 Claims, 3 Drawing Sheets

3D FIVE-CHANNEL STEREO EARPHONE

TECHNICAL FIELD

The present invention relates to an earphone technical field, particularly to a 3D five-channel stereo earphone.

BACKGROUND OF THE INVENTION

Headphones are a pair of converting units that receive the electric signals from a media player or receiver and convert such electrical signals into sound waves through the loudspeaker in one's ears.

Presently, headphones, as listening devices, are widely used in different field since most headphones are at the agreeable prices and of high portability. Meanwhile, they also offer great comfort of users without annoying others. The common headphones can be divided into several categories, including circumaural headphones, clip headphones and, canalphones, etc. In fact, there are various categories of headphones of different appearance. At present, there are mainly 2-channel stereo headphones, with namely the left channel stereo and the right channel stereo, in the market. Each sounding device of a pair of 2-channel stereo headphones is only equipped with one sounding unit and therefore cannot reproduce the 5.1-channel stereo signal source without impairment. Some may claim that their headphones can perfectly maintain the fidelity of the 5.1-channel stereo sound. In fact, the so-called 5.1-channel stereo sound is in fact a simulated 5.1-channel stereo sound, rather than the real reproduction of the physical 5.1-channel stereo sound.

With the modern society developing, consumers have increasingly higher requirements for the sound effects of headphones because they expect the 3D stereo sound when watching films, appreciating concert videos or playing VR games and realize precise positioning and direction orienting as well as instant response by means of the 5.1-channel stereo sound when playing games. However, to reproduce the 5.1-channel stereo sound, the electronic circuit or relevant software must be applied to the existing headphones and it is relatively difficult to install the electronic circuit in the small headphones. Moreover, adding, the electronic circuit means significant increase in cost of manufacture of a pair of headphones, which leads to the sales price rising perpendicularly and produces market competitiveness weakened.

Hence, the following technical solutions are offered.

DESCRIPTION OF THE INVENTION

The objection of the present invention is to overcome the deficiency of the current technology by providing a 3D five-channel stereo earphone.

In order to solve the above-mentioned problems and achieve the objective of the present invention, the technical scheme is to provide a 3D five-channel stereo earphone, comprising: a rear housing, a frame installed on the rear housing, a loudspeaker mounted at, a bottom of the frame, a front housing installed on the rear housing; the frame and loudspeaker being sealed and installed in a cavity between the rear housing and the front housing; the front housing having an output; the frame including several mutually isolated output channels connected to the output; the output channels having input holes disposed at the bottom of the frames and on the same horizontal plane; the output channels having output holes disposed on an upper surface of the frame, and the vertical distances between the output holes and the output are different.

More particularly, wherein the output holes of the output channels differ in apertures and dimensions.

More particularly, wherein the output channels includes five output channels in total, among which, a first, second, third, fourth and fifth input holes of a first, second, third, fourth, and fifth output channels are disposed at the bottom of the frame; a first, second, third, fourth, and fifth output holes of the first, second, third, fourth, and fifth output channels are disposed on the upper surface of the frame.

More particularly, wherein the first, second, third, fourth, and fifth output holes become smaller in apertures and dimensions.

More particularly, wherein the frame comprises a lower frame disposed on the rear housing and an upper frame mounted on the lower frame; the first, second, third, fourth, and fifth input, holes are disposed at a bottom of the lower frame; the first output hole is disposed at an upper surface of the lower frame; the lower frame is formed with a first convex ring disposed on the upper surface thereof, of which an upper port is the second output hole; the upper frame is formed as a funnel shaped component and includes a first, second, and third cavities isolated from each other and respectively connected to the third, fourth, and fifth input holes; the upper frame has, a taper surface disposed on a top thereof and a tube disposed on a top of the taper surface; the third and fourth output holes are on the taper surface and respectively connected to the first and second cavity; the tube is connected to the third cavity, and a port of the tube is considered to be the fifth output hole.

More particularly, wherein upper frame has a partition hoard disposed therein and configured to divide the cavity of the upper frame into the first and second cavities; the partition board is opened with the third cavity disposed, along from bottom to top and connected to the tube.

More particularly, wherein the lower frame comprises a first and second curved spacing parts in convex shapes, and a convex ring disposed between the first and second curved spacing parts and; the first and second curved spacing parts form a limited space and has a spacing slot disposed therebetween; the upper frame has a spacing part disposed at an outside edge of the bottom thereof and the third cavity has a connecting slot disposed at a lower port thereof; the bottom of the upper frame is mounted on the spacing area and the connecting slot of the upper frame is connected to the convex ring; the spacing part at the bottom of the upper frame is installed in the spacing slot so that the upper frame is mounted on the lower frame.

More particularly, wherein the frame comprises a step slot disposed at the bottom thereof, the loudspeaker is mounted on the step slot, and the loudspeaker and the input holes of the output channel are formed with a gap disposed therebetween.

More particularly, wherein the front housing comprises an adapter sleeved thereon.

By adoption of the above-mentioned technical solutions, compared to the existing technology, the invention can produce the favorable outcomes as follows: in practical application, the loudspeaker of the invention can produce five pitches (high pitch, alt, mediant, mid-bass and bass) which respectively travel along five different output channels supported by the frame and join together at the output. Yet, the vertical, distances between the output holes of the five output channels and the described output are different and the five output holes also differ in apertures and dimensions that become smaller with the pitch going higher so that five different frequency divisions are formed after the described five pitches of the sound from the loudspeaker respectively travel through the first, second, third, fourth and fifth output channels to offer a broader range compass composed of five different levels of pitches, thereby realizing the special sound effect composed of the simulated five-channel stereo sound and achieving the ideal 3D effect.

Compared to the existing headphones that optimize rather the acoustic quality and timbre than the sound effects by making modifications to the physical structure of headphones, the electronic circuit and software play an essential part in the improvement of sound effects. Yet, the invention introduces a special design relating to the physical structure of headphones that enables the optimum sound effects, acoustic quality, stimulated 3D sound effects and the 5.1-channel stereo sound, namely the sound effects that the existing headphones can never achieve without adding any electronic circuits or applications. The technology introduced by the invention also effectively reduces the cost of manufacture of headphones and strengthens the product's market competitiveness.

DETAILED DESCRIPTION OF THE INVENTION

The following detailed embodiments and maps are provided for further description of the invention.

Figure 1:
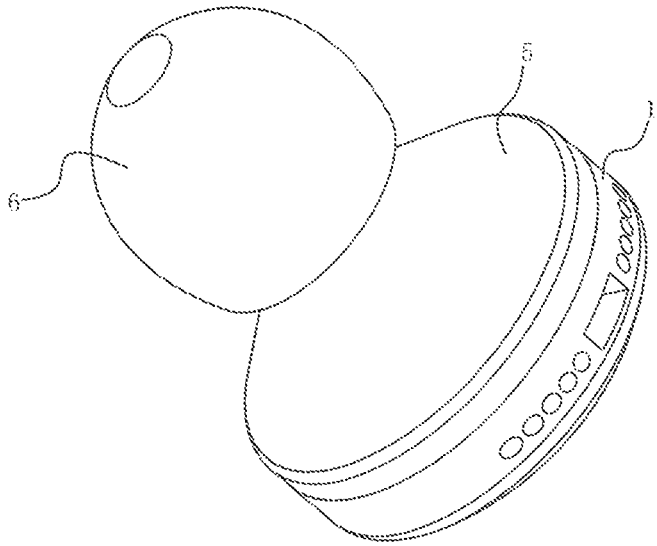
FIG. 1 is a schematic view of the present invention.
Figure 2:
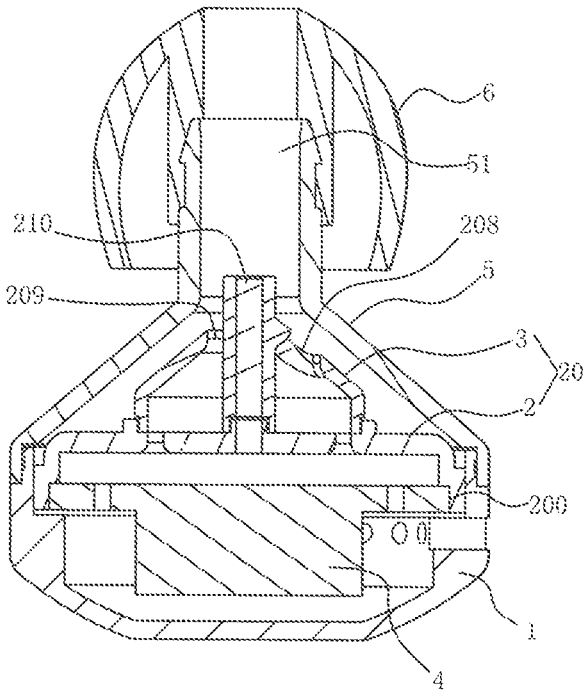
FIG. 2 is a cross-sectional view of the present invention.
Figure 3:
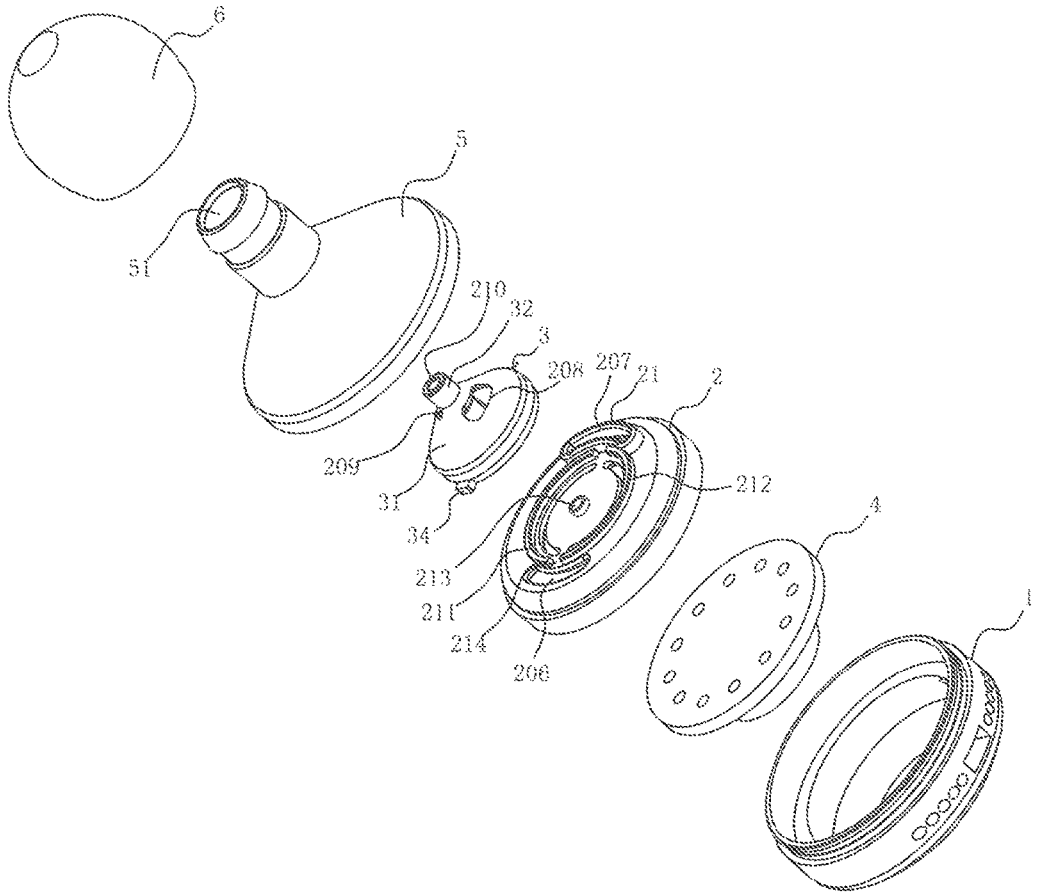
FIG. 3 is an exploded view of the present invention.

As shown in FIG. 1 to FIG. 3, the invention relates a 3D five-channel stereo earphones comprising a rear housing (1), a frame (20) installed on the rear housing (1), a loudspeaker (4) mounted at a bottom the frame (20), a front housing (5) installed on the rear housing (1), an ear adapter (6) sleeved on the front housing (5). The frame (20) and loudspeaker (4) are sealed and installed in a cavity between the rear housing (1) and the front housing (5). The front housing (5) has an output (51) and the sound produced by the loudspeaker (4) travels along the frame (20) and arrives at the output (51).

The frame (20) comprises a step slot (200) disposed at the bottom thereof, the loudspeaker (4) is mounted on the step slot (200), and the loudspeaker (4) and the input holes of the output channel are formed with a gap disposed therebetween.

The frame (20) is stalled with several mutually isolated output channels connected to the output (51). The output channels having input holes disposed at the bottom of the frames (20) and on the same horizontal plane. The output channels comprise output holes disposed on an upper surface of the frame (20). In addition, the vertical distances between the output holes and the output (51) are different and the output holes of the output channels also differ in apertures and dimensions.

Figure 4:
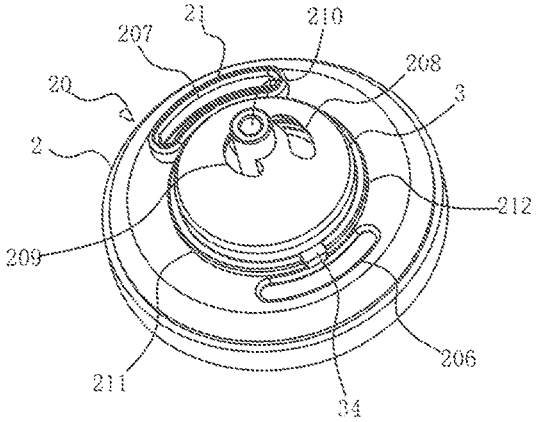
FIG. 4 is a schematic view of a frame of the present invention.
Figure 5:
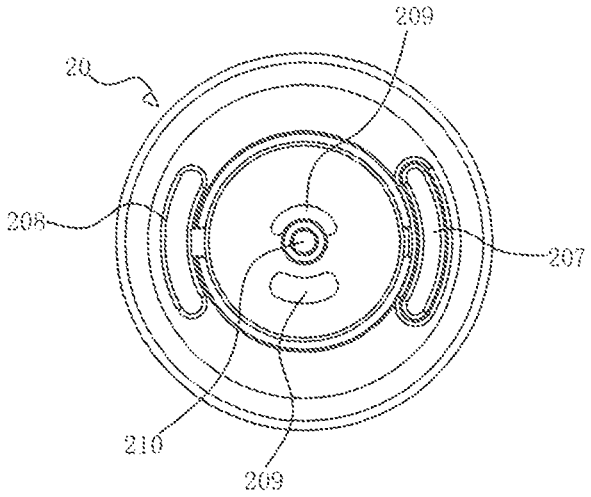
FIG. 5 is a top plane view of the frame of the present invention.
Figure 6:
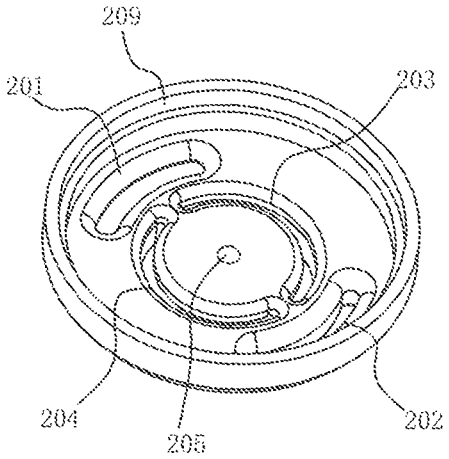
FIG. 6 is a schematic view of a lower frame of the present inversion.

Specifically speaking, as shown FIGS. 4, 5 and 6, the output channels includes live output channels in total, among which, a first, second, third, fourth and fifth input holes (201, 202, 203, 204 and 205) of a first, second, third, fourth, and fifth output channels are at the bottom of the frame (20). A first, second, third, fourth, and fifth output holes (206, 907, 208, 209 and 210) of the first, second, third, fourth, and fifth output channels are on the upper surface of the frame (20). Particularly, the first, second, third, fourth, and fifth output holes (206, 207, 208, 209, and 210) become smaller in apertures and dimensions.

Since the vertical distances between the first, second, third, fourth, and fifth output holes (206, 207, 208, 209, and 210) and the output (51) differ, and the first, second, third, fourth, and fifth output holes (206, 207, 208, 209, and 210) become smaller in apertures and dimensions, so that the audio from the loudspeaker (4) will be divided into five channels when traveling through the frame (20). In other words, the 7-key pitch will be averagely divided into 5 pitches: 20 Hz~120 Hz (bass), 120 Hz~391 Hz (mid-bass), 440 Hz~1568 Hz (mediant), 1760 Hz~4186 KHz (alt) and 4186 KHz~20 KHz (high pitch), which respectively travel through the first, second, third, fourth and fifth output channel and eventually join together to pass the output (51). That is to say, when the sound from the loudspeaker (4) travels through the first, second, third, fourth, and fifth output channels, five different frequency divisions are formed to offer a broad range compass composed of five different levels of pitches, thereby realizing the special sound effect composed of the simulated 5-channel stereo sound and achieving the ideal 3D effect.

The first, second, third, fourth, and fifth output holes (206, 207, 208, 209, and 210) have tuning paper to ensure better acoustic quality of the five pitches and more favorable 3D effect.

Figure 7:
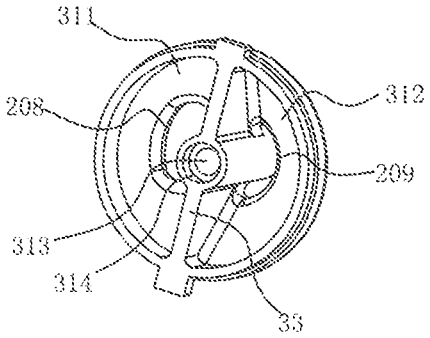
FIG. 7 is a schematic view of an upper frame of the present invention.

As shown in FIGS. 3, 4 and 6, the frame (20) comprises a lower frame (2) disposed on the rear housing (1) and an upper frame (3) mounted on the lower frame (2). The first, second, third, fourth, and fifth input holes (201, 202, 203, 204 and 205) are disposed at a bottom of the lower frame (2); the first output hole (206) is disposed at an upper surface of the lower frame (2). The lower frame (2) is formed with a first convex ring (21) disposed on the upper surface thereof, of which an upper port is the second output hole (207). The upper frame (3) is formed as a funnel shaped component and includes a first, second, and third cavities (311, 312 and, 313) isolated from each other and respectively connected to the third, fourth, and fifth input holes (203, 204, and 205). As shown in FIG. 7, the upper frame (3) has a taper surface (31) disposed on a top thereof and a tube (32) disposed on a top of the taper surface (31). The third and fourth output holes (208 and 209) are on the taper surface (31) and respectively connected to the first and second cavity (311 and 312). The tube (32) is connected to the third cavity (313). In addition, a port of the tube (32) is considered to be the fifth output hole (210). To be specific, the upper frame (3) has a partition board (33) disposed therein and configured to divide the cavity of the upper frame (3) into the first and second cavities (311 and 312). In addition, the partition board (33) is opened with the third cavity (313) along from bottom to top. Besides, the lower frame (2) comprises a first and second curved spacing parts (211 and 212) in convex shapes, and a convex ring (213) disposed between the first and second curved spacing parts (211 and 212). The first and second curved spacing parts (211 and 212) form a limited space and has a spacing slot (214) disposed therebetween. The upper frame (3) has a spacing part (34) disposed at an outside edge of the bottom thereof and the third cavity (313) has a connecting slot (314) disposed at a lower port thereof. The bottom of the upper frame (3) is mounted on the spacing area and the connecting slot (314) of the upper frame (3) is connected to the convex ring (213). The spacing part (34) at the bottom of the upper frame (3) is installed in the spacing slot (214) so that the upper frame (3) is mounted on the lower frame (2).

In this embodiment, the lower frame (2) and the upper frame (3) are respectively produced by means of injection molding and are assembled as the detachable frame (20) afterwards. The lower frame (2) and the upper frame (3) may also be placed in a die for injection molding to produce a non-detachable frame (20).

To sum up, in practical utilization, the loudspeaker (4) of the invention can produce five pitches (high pitch, alt, mediant, mid-bass and bass) which respectively travel along five different output channels supported by the frame (20) and join together at the output (51). Yet, the vertical distances between the output holes of the five output channels and the output (51) are different and the five output holes also differ in apertures and dimensions that become smaller with the pitch going higher. As a result, five different frequency divisions are formed after the five pitches of the sound from the loudspeaker (4) respectively travel through the first, second, third, fourth and fifth output channels to offer a broader range compass composed of five different levels of pitches, thereby realizing the special sound effect composed of the simulated 5-channel stereo sound and achieving the ideal 3D effect. In other words, the physical structure of the headphone in the invention without adding any electronic circuits or applications can also offer a broader range compass composed of five different levels of pitches, achieving the special sound effect composed of the simulated five-channel stereo sound and achieve the ideal 3D effect with the sound generated by the loudspeaker (4).

In conclusion, compared to the existing headphones that optimize rather the acoustic quality and timbre than the sound effects by making modifications to the physical structure of headphones, the electronic circuit and software play an essential part in the improvement of sound effects. Yet, the invention introduces a special design relating to the physical structure of the headphone that enables the optimum sound effects, acoustic quality, stimulated 3D sound effects and the 5.1-channel stereo sound, namely the sound effects that the existing headphones can never achieve without adding any electronic circuits or applications. The technology introduced by the invention also effectively reduces the cost of manufacture of headphones and strengthens the product's market competitiveness.

I claim:

1. A 3D five-channel stereo earphone, comprising:

a rear housing (1), a frame (20) installed on the rear housing (1), a loudspeaker (4) mounted at a bottom of the frame (20), a front housing (5) installed on the rear housing (1); the frame (20) and loudspeaker (4) being sealed and installed in a cavity between the rear housing (1) and the front housing (5); the front housing (5) having an output (51);

the frame (20) including several mutually isolated output channels connected to the output (51); the output channels having input holes disposed at the bottom of the frame (20) and on a same horizontal plane; the output channels having output holes disposed on an upper surface of the frame (20), and vertical distances between the output holes and the output (51) are different;

wherein the output channels include five output channels in total, among which, first, second third, fourth and fifth input holes (201, 202, 203, 204 and 205) of first, second, third, fourth, and fifth output channels are disposed at the bottom of the frame (20); first, second, third, fourth, and fifth output holes (206, 207, 208, 209 and 210) of the first, second, third, fourth, and fifth output channels are disposed on the upper surface of the frame (20); wherein the frame (20) comprises a lower frame (2) disposed on the rear housing (1) and an upper frame (3) mounted on the lower frame (2); the first, second, third, fourth, and fifth input holes (201, 202, 203, 204 and 205) are disposed at a bottom of the lower frame (2); the first output hole (206) is disposed at an upper surface of the lower frame (2); the lower frame (2) is formed with a first convex ring (21) disposed on the upper surface thereof, of which an upper port is the second output hole (207); the upper frame (3) is formed as a funnel shaped component and includes a first, second, and third cavities (311, 312 and, 313) isolated from each other and respectively connected to the third, fourth, and fifth input holes (203, 204, and 205); the upper frame (3) has a taper surface (31) disposed on a top thereof and a tube (32) disposed on a top of the taper surface (31); the third and fourth output holes (208 and 209) are on the taper surface (31) and respectively connected to the first and second cavity (311 and 312); the tube (32) is connected to the third cavity (313), and a port of the tube (32) is considered to be the fifth output hole (210).

2. The 3D five-channel stereo earphone according to claim 1, wherein the output holes of the output channels differ in apertures and dimensions.

3. The 3D five-channel stereo earphone according to claim 1, wherein the upper frame (3) has a partition board (33) disposed therein and configured to divide the cavity of the upper frame (3) into the first and second cavities (311 and 312); the partition board (33) is opened with the third cavity (313) disposed along from bottom to top and connected to the tube (32).

4. The 3D five-channel stereo earphone according to claim 1, wherein the lower frame (2) comprises a first and second curved spacing parts (211 and 212) in convex shapes, and a convex ring (213) disposed between the first and second curved spacing parts (211 and 212); the first and second curved spacing parts (211 and 212) form a limited space and have a spacing slot (214) disposed therebetween; the upper frame (3) has a spacing part (34) disposed at an outside edge of the bottom thereof and the third cavity (313) has a connecting slot (314) disposed at a lower port thereof; the bottom of the upper frame (3) is mounted on a spacing area and the connecting slot (314) of the upper frame (3) is connected to the convex ring (213); the spacing part (34) at the bottom of the upper frame (3) is installed in the spacing slot (214) so that the upper frame (3) is mounted on the lower frame (2).

5. The 3D five-channel stereo earphone according to claim 1, wherein the frame (20) comprises a step slot (200) disposed at the bottom thereof, the loudspeaker (4) is mounted on the step slot (200), and the loudspeaker (4) and the input holes of an output channel are formed with a gap disposed therebetween.

6. The 3D five-channel stereo earphone according to claim 1, wherein the front housing (5) comprises an adapter (6) sleeved thereon.

* * * * *